US007235730B2

(12) United States Patent
Hirayama

(10) Patent No.: US 7,235,730 B2
(45) Date of Patent: Jun. 26, 2007

(54) BRIDGE FOR STRINGED INSTRUMENT AND STRINGED INSTRUMENT

(75) Inventor: Shinjiro Hirayama, Aichi (JP)

(73) Assignee: Hoshina Gakki Co., Ltd. (JP)

( * ) Notice: Subject to any disclaimer, the term of this patent is extended or adjusted under 35 U.S.C. 154(b) by 154 days.

(21) Appl. No.: 11/040,309

(22) Filed: Jan. 21, 2005

(65) Prior Publication Data

US 2005/0160897 A1 Jul. 28, 2005

(30) Foreign Application Priority Data

Jan. 23, 2004 (JP) ..... 2004-016036

(51) Int. Cl.
*G10D 3/04* (2006.01)

(52) U.S. Cl. ..... 84/307; 84/313

(58) Field of Classification Search ..... 84/307, 84/313

See application file for complete search history.

(56) References Cited

U.S. PATENT DOCUMENTS

| | | | | |
|---|---|---|---|---|
| 4,106,387 | A | 8/1978 | Alifano | 84/312 |
| 5,359,144 | A | 10/1994 | Benson | 84/313 |
| 6,175,066 | B1 * | 1/2001 | McCabe | 84/313 |

FOREIGN PATENT DOCUMENTS

| | | |
|---|---|---|
| JP | 5-17690 | 5/1993 |
| JP | 2001-255869 | 9/2001 |
| JP | 2003-177741 | 6/2003 |
| JP | 2003-223163 | 8/2003 |

OTHER PUBLICATIONS

Japanese Office Action dated Jul. 25, 2006.

* cited by examiner

*Primary Examiner*—Lincoln Donovan
*Assistant Examiner*—Jianchun Qin
(74) *Attorney, Agent, or Firm*—Ostrolenk, Faber, Gerb & Soffen, LLP

(57) ABSTRACT

A bridge for a stringed instrument located on an upper surface of a body of the stringed instrument including lever arm retainers located on the upper surface of the body. Each lever arm retainer corresponds to one of the strings. Each lever arm retainer includes a support shaft extending in a direction perpendicular to the corresponding string. Lever arms are supported by the support shafts. Each lever arm retains an end of one of the strings and is rotatable about the corresponding support shaft. Each fine tuning bolt includes a contact portion that abuts against the corresponding lever arm above the body. Each contact portion is continuously adjustable in the height direction of the body. The tuner device discretely changes the height of the contact portion.

17 Claims, 11 Drawing Sheets

BRIDGE FOR STRINGED INSTRUMENT AND STRINGED INSTRUMENT

BACKGROUND OF THE INVENTION

The present invention relates to a bridge for a stringed instrument and a stringed instrument such as an electric guitar equipped with the bridge for a stringed instrument. More specifically, the present invention pertains to a bridge for a stringed instrument that can perform alternate tuning by one-touch operation and a stringed instrument equipped with the bridge for a stringed instrument.

A stringed instrument such as a guitar is normally played in standard tuning, but occasionally tuned to alternate tuning by changing the tension of a particular string. For example, a sixth string of a guitar is normally tuned to E. However, an alternate tuning is sometimes performed by tuning the sixth string down a whole step to D, which is called a D tune. In this case, rotating a tuning peg to loosen the tension of the string tunes the string to a low pitch from a high pitch. However, it is too complicated to tune the guitar taking a long time during performance. On the other hand, it is also complicated to prepare several guitars that are tuned differently from each other.

It is further complicated in a case with a guitar equipped with a tremolo unit. In this case, even if only the sixth string is tuned a whole step down with the tuning peg, the total tension of the six strings is changed. Therefore, the force applied to the tremolo block against the tension of the strings and the tension of the string become off balance, and the tension of the five strings other than the sixth string is undesirably increased. In this case, the tension of each of the five strings must be adjusted with the tuning peg to balance the entire forces.

Therefore, a tension changing device for a stringed instrument equipped with a tremolo unit has been proposed in U.S. Pat. No. 5,359,144. The tension changing device is mounted on a guitar equipped with a tremolo unit and includes a base plate 123 as shown in FIG. 12. A flange plate 123*a* extends diagonally upward from the rear portion of the base plate 123. Fine tuning adjustment screws 142 are screwed into the rear end of the flange plate 123*a* from above and downward.

Front segments 135, each of which corresponding to one of strings, are secured to the front portion of the base plate 123. Each front segment 135 rotatably supports a rear segment 137 via a support shaft 138. The proximal end of each string 115 is retained between the corresponding rear segment 137 and a clamping block 139 located in the rear segment 137. Therefore, the rear segments 137 are urged forward (toward a head) by the tension of the strings 115 with the base plate 123.

Knife edges 129 are formed at the front end of the base plate 123. Each knife edge 129 is engaged with a stud bolt 131 secured to a body so that the base plate 123 is tiltably supported by the body. A tremolo block 145 (partially shown in FIG. 12) is located below the base plate 123. The tremolo block 145 is urged forward of the body by coil springs (not shown). Therefore, since the base plate 123 is tiltably held by the balance between the tension of the strings 115 and the force of the coil springs, the base plate 123 is tilted by manipulating a tremolo arm 130.

A shank 190, which extends rearward, is secured at the rear end of each rear segment 137. The shank 190 extends rearward through the flange plate 123*a* and the rear end of the shank 190 is coupled to a shifting member 191. The shifting member 191 can be shifted forward and rearward while the shank 190 is loosely fit inside. Each rear segment

137 and the corresponding shank 190 are urged forward of the body by the tension of the corresponding string 115. Therefore, the shifting member 191 is also urged to rotate counterclockwise about the support shaft 138 as viewed in FIG. 12. Therefore, in a state shown in FIG. 12, an upper flat surface 191*a* of the shifting member 191 abuts against the lower end of the corresponding fine tuning adjustment screw 142 located above the upper flat surface 191*a*.

A leaf spring 192 is secured to the lower surface of the base plate 123. The rear end of the leaf spring 192 abuts against the lower surface of the shifting member 191. Therefore, the shifting member 191 is urged upward by the leaf spring 192. In this state, for example, the sixth string is tuned to E by rotating the corresponding tuning peg on the head, and fine tuning can further be performed by rotating the fine tuning adjustment screw 142 as required.

Next, a case where the sixth string 115 is tuned down a whole step to D from the state shown in FIG. 12 will now be described with reference to FIG. 13. At first, the shifting member 191 is held by hand and pulled rearward so that the shifting member 191 is shifted rearward. Then, the distal end of the corresponding leaf spring 192 is fitted in an engaging recess 191*b* formed at the front end of the lower surface of the shifting member 191, and the shifting member 191 is fixed. At this time, the corresponding rear segment 137, the shank 190, and the shifting member 191 are urged counterclockwise as viewed in FIG. 12 by the tension of the string 115 about the support shaft 138. Therefore, the upper flat surface 191*a* of the shifting member 191 is disengaged from the lower end of the fine tuning adjustment screw 142. The lower end of the fine tuning adjustment screw 142 then abuts against the shank 190. Accordingly, the rear segment 137, the shank 190, and the shifting member 191 are rotated counterclockwise about the support shaft 138 by a predetermined thickness of the shifting member 191. As a result, the tension of the sixth string 115 is reduced and the sixth string 115 is tuned to D from E. Thus, according to the U.S. Pat. No. 5,359,144, a bridge for a stringed instrument that is not equipped with the tremolo unit can perform alternate tuning by shifting the shifting member 191 rearward. Also, according to such a bridge for a stringed instrument, the string 115 can be automatically tuned back to E by returning the fine tuning adjustment screw 142 to the state shown in FIG. 12.

On the other hand, according to the bridge for a stringed instrument equipped with the tremolo unit, even if the device of FIG. 12 is applied, the total tension of the six strings is reduced by the influence of the sixth string that has been adjusted to reduce its tension. Therefore, the force of the spring of the tremolo unit and the tension of each string become off balance. Therefore, since the tension of each of the first to fifth strings is increased, the tension of each of the five strings must be adjusted again. Thus, according to the tremolo unit of the above publication, after performing alternate tuning with the shifting member 191, the force of the spring for the tremolo unit must be manually adjusted to regain the balance of the entire tremolo unit.

However, according to the above mentioned bridge for a stringed instrument, when performing alternate tuning using the shifting member 191, the sixth string 115 cannot be guaranteed to be correctly tuned to D due to the property of the sixth string 115 itself and the influence of the entire tension even if the accuracy of the shifting member 191 is increased. Therefore, it is possible to tune the sixth string 115 to approximately D, but the sixth string 115 must be correctly tuned by manipulating the fine tuning adjustment screw 142 before playing the guitar. Furthermore, when tuning the sixth string 115 back to E by pressing the shifting member 191 forward after correctly tuning the sixth string 115 to D, the tuning state becomes inaccurate and the sixth string 115 cannot be restored to E. Such a problem occurs with a bridge that is not equipped with the tremolo unit.

In addition, according to the bridge equipped with the tremolo unit, even if the sixth string is accurately adjusted, the entire balance goes wrong. Therefore, according to the conventional unit shown in FIG. 12, it is possible to tune all the strings at the same time, but each string must be fine-tuned manually before playing the guitar. Thus, the adjustment procedure is complicated.

Furthermore, in the above mentioned invention, the shifting member 191 projects rearward of the body. Therefore, when the tremolo arm 130 is pulled upward, a space is necessary so that the shifting member 191 do not interfere with the body. Particularly, as shown in FIG. 13, when the sixth string 115 is tuned to D, the shifting member 191 further projects rearward by a large amount. Thus, a large space is required between the body and the shifting member 191. Therefore, the above described tremolo unit requires a special body and cannot be replaced with the conventional tremolo unit. That is, the tremolo unit of the above publication lacks versatility.

SUMMARY OF THE INVENTION

Accordingly, it is an objective of the present invention to provide a bridge for a stringed instrument that can easily perform accurate alternate tuning and a stringed instrument that is equipped with the bridge for a string instrument.

To achieve the above objective, one embodiment of the present invention provides a bridge for a stringed instrument, which is located on an upper surface of a body of a stringed instrument equipped with a plurality of strings. The bridge for a stringed instrument includes lever arm retainers located on the upper surface of the body. Each lever arm retainer corresponds to one of the strings. Each lever arm retainer includes a support shaft, which extends in a direction perpendicular to the corresponding string. The bridge for a stringed instrument further includes lever arms each supported by one of the support shafts, fine tuning bolts each located in a rear portion of one of the lever arm retainers, and a tuner device located on the fine tuning bolt that corresponds to at least one of the strings. Each lever arm retains an end of one of the strings and is rotatable about the corresponding support shaft. Each fine tuning bolt includes a contact portion that abuts against the corresponding lever arm above the body. Each contact portion is continuously adjustable in the height direction of the body. The tuner device discretely changes the height of the contact portion.

Another embodiment of the present invention provides a bridge for a stringed instrument, which is located on an upper surface of a body of a stringed instrument equipped with a plurality of strings. The bridge includes a base plate, a plurality of lever arms, a plurality of fine tuning bolts, and a tuner device. The base plate is located on the upper surface of the body and includes a support shaft. The shaft extends in a direction perpendicular to the strings. The lever arms are supported by the support shaft. Each lever arm retains an end of the one of the strings and is rotatable about the support shaft. Each fine tuning bolt is located in a rear portion of the base plate, and includes a contact portion that abuts against the corresponding lever arm above the body. Each contact portion is continuously adjustable in the height direction of the body. The tuner device is located on the fine tuning bolt that corresponds to at least one of the strings. The tuner device discretely changes the height of the contact portion.

The present invention also provides a stringed instrument equipped with the bridge for a stringed instrument.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An electric guitar 11 according to a first embodiment of the present invention will now be described with reference to FIGS. 1 to 10. The electric guitar is equipped with a tremolo unit.

Figure 1:
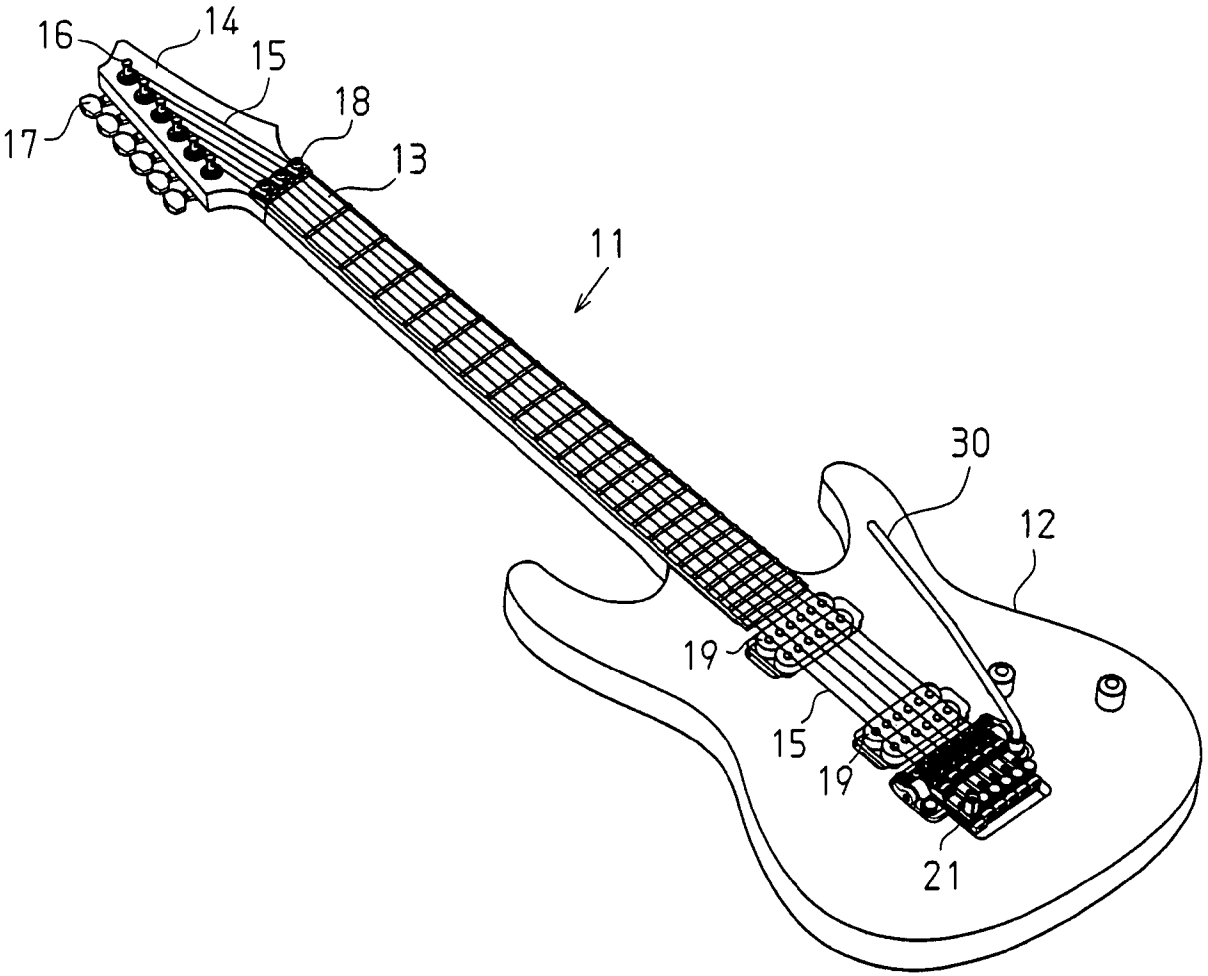
FIG. 1 is a perspective view illustrating an electric guitar according to a first embodiment of the present invention.

As shown in FIG. 1, the electric guitar 11 includes a solid type body 12, a neck 13, which extends forward from the body 12, and a head 14, which is connected to the front end of the neck 13. Six tuning posts 16 project from the upper surface of the head 14 to wind up strings 15. Tuning pegs 17, which project outward from the rim of the head 14, are provided at the rear surface of the head 14. When each tuning peg 17 is rotated, the corresponding tuning post 16 is rotated by a gear mechanism, which is not shown, located at the rear surface of the head 14. The pitch (tension) of each string 15 is adjusted by the corresponding tuning post 16, the corresponding gear mechanism, and the corresponding tuning peg 17. The strings 15 contact a nut 18 located at the distal end of the neck 13 such that the strings 15 can vibrate above the neck 13. Hereinafter, the contact between the nut 18 and each string 15 is referred to as a first contact point. The first embodiment employs a locking nut structure in which a pressing member abuts against the upper surfaces of the strings 15 and is tightened to the nut 18 with bolts to prevent the pitch of the strings 15 from fluctuating.

A bridge of the present invention, which is a tremolo unit 21, is located slightly rearward of the center of the body 12. The bridge of the present invention refers to an entire unit that supports strings rearward of the first contact point. The six strings 15 contact the nut 18 at the first contact point and contacts a tremolo unit 21 at a second contact point. The six strings 15 extend substantially parallel to each other while being pulled at a certain tension between the first contact point and the second contact point. Each string 15 vibrates between the first contact point and the second contact point while the guitar is being played. Pickups 19, which detect vibration of the strings 15 and convert the vibration into electric signals, are located between the body 12 and the strings 15. The electric signals converted by the pickups 19 are transmitted to an amplifier via a cable (not shown) to be amplified and converted into sound.

Figure 2:
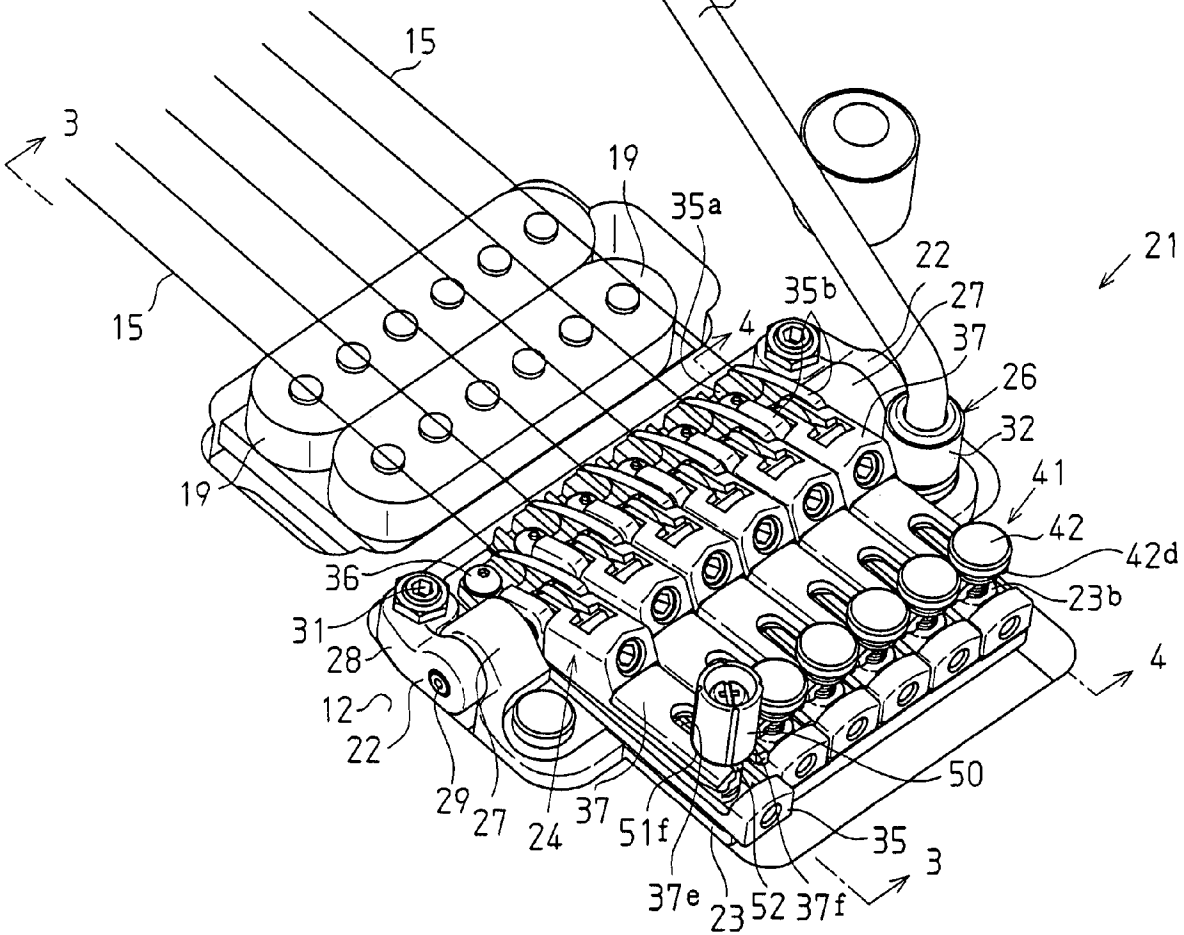
FIG. 2 is a partial perspective view illustrating the vicinity of the tremolo unit of the electric guitar.
Figure 3:
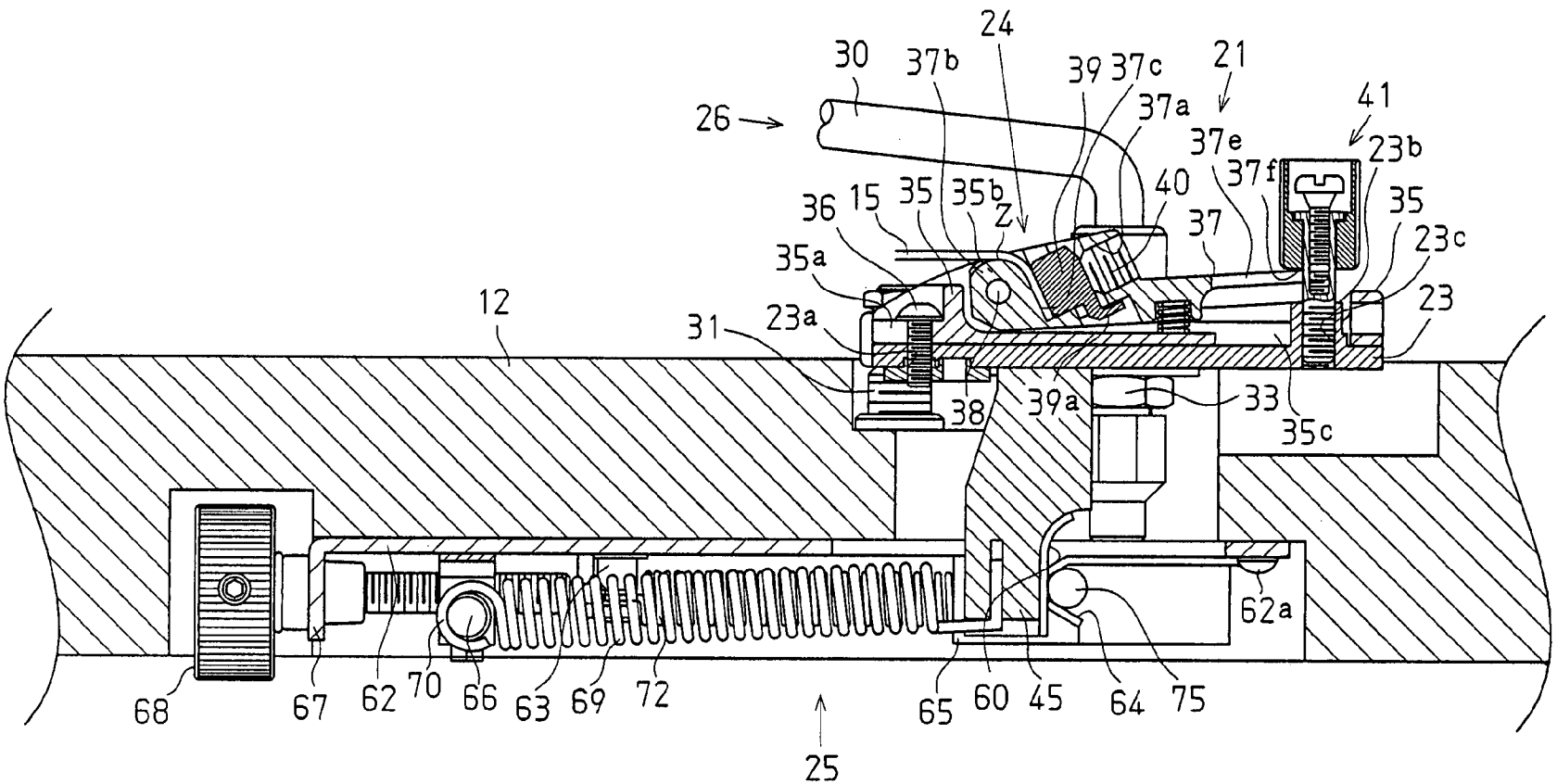
FIG. 3 is a partial cross-sectional view taken along line 3-3 of FIG. 2.

As shown in FIGS. 2 and 3, the tremolo unit 21 includes a base plate 23 pivotally arranged on the body 12 by a hinge mechanism 22, and bridge saddles 24, which are arranged on the upper surface of the base plate 23 and support the strings 15. The base plate 23 includes fine tuning devices 41 and a D tuner device 50. Each of the fine tuning devices 41 corresponds to one of the strings 15. A tremolo manipulation mechanism 26 is provided on the base plate 23 to rotate the base plate 23 about the hinge mechanism 22. As shown in FIG. 3, the tremolo unit 21 includes a tension applying mechanism 25, which urges the base plate 23 against the tension of the strings 15.

As shown in FIG. 2, the hinge mechanism 22 includes a pair of brackets 28 and a pair of rotary shafts 29 (only one is shown). Each bracket 28 is secured to the body 12 with a stud bolt 31. Each rotary shaft 29 is supported by both ends of one of the brackets 28. Two bearing devices 27 are formed on left and right sides of the base plate 23. A bearing is inserted in each of the bearing devices 27 and pivotally supports the base plate 23 such that the base plate 23 pivots with respect to the body 12 via the corresponding rotary shaft 29.

As shown in FIGS. 2 and 3, each bridge saddle 24 includes a lever arm 37, which supports one of the strings 15, and a lever arm retainer 35, which pivotally supports the lever arm 37. A slot 35*a*, which extends forward corresponding to the associated string 15, is formed at the front end of the lever arm retainer 35. As shown in FIG. 3, threaded bores 23*a* (only one is shown) are formed in the base plate 23. The head of a bolt 36, which is screwed into each threaded bore 23*a*, is inserted in the corresponding slot 35*a* and the bolt 36 abuts against the surrounding portion of the slot 35*a*. As a result, each lever arm retainer 35 is secured to the upper surface of the base plate 23. When each bolt 36 is loosened, the corresponding bridge saddle 24 becomes movable in the front and rear directions with respect to the base plate 23. Therefore, the harmonics on each string 15 can be tuned.

As shown in FIG. 3, a bearing 35*b* is formed in each lever arm retainer 35. Each bearing 35*b* supports a first support shaft 38, which extends in a direction perpendicular to the corresponding string 15. Each first support shaft 38 pivotally supports the corresponding lever arm 37 via a string receiver 37*b* located at the front end of the lever arm 37. A cuboid clamp block 39 is fitted to an opening formed on each lever arm 37. A hook-like projection 39*a* extends from the lower portion of each clamp block 39 to prevent the clamp block 39 from falling off the opening portion. Each clamp block 39 is fixed to the corresponding lever arm 37 by a string fixing bolt 40 screwed into a threaded bore 37*a*, which extends rearward from the opening portion. The end of each string 15 is inserted in a space between one of the clamp block 39 and the front wall of the opening portion of the corresponding lever arm 37, that is, a sandwiching surface 37*c*. The end of each string 15 is held between one of the clamp blocks 39 and the corresponding sandwiching surface 37*c* by tightening the string fixing bolt 40. In the first embodiment, each clamp block 39 and the corresponding string fixing bolt 40 constitute string holding means.

Figure 4:
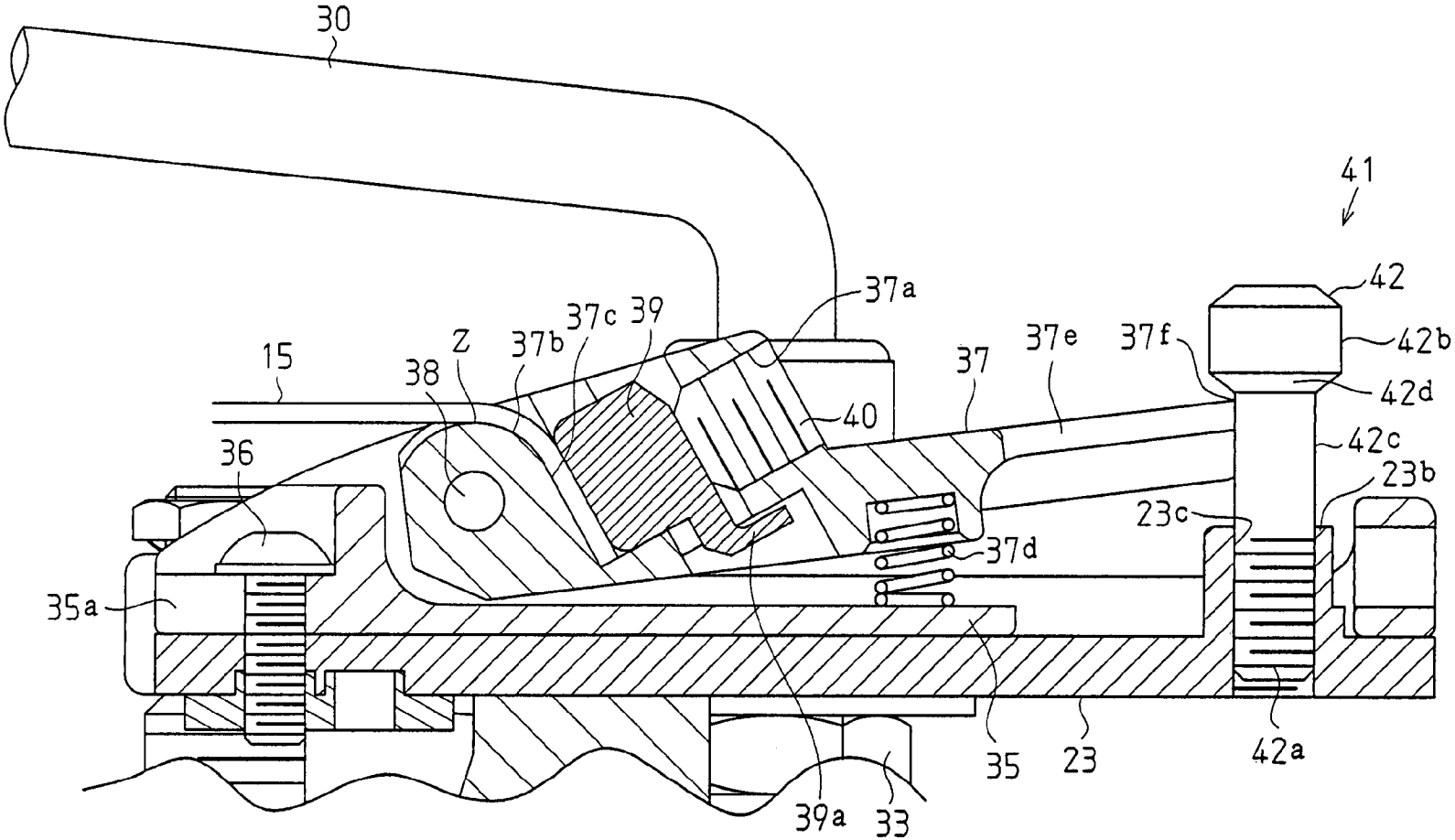
FIG. 4 is a partial cross-sectional view taken along line 4-4 of FIG. 2.

The upper surface of the front end of each lever arm 37 is a curved surface formed by an outer surface of a cylinder that has its center at the corresponding first support shaft 38. The curved surface forms a string receiver 37*b*. Each string receiver 37*b* includes the second contact point Z, which contacts the corresponding string 15 such that the string 15 can vibrate above the neck 13 and the body 12. As shown in FIGS. 2 to 4, a rear end 37*f* is formed at the rear portion of each lever arm 37. The rear end 37*f* can abut against a contact portion 42*d* of a fine tuning bolt 42 or a lower end 51*f* of a tuner knob 51 of the D tuner device 50. A slit 37*e*, which extends rearward, is formed at the center of each lever arm 37. Each fine tuning bolt 42 or a base screw 52 of the D tuner device 50 is inserted through the corresponding slit 37*e*.

The tremolo manipulation mechanism 26 will now be described with reference to FIGS. 2, 3, and 10. The tremolo manipulation mechanism 26 includes a threaded cylinder 32, which is located at the side portion of the base plate 23 and faces downward, and a nut 33, which is screwed into the lower end of the threaded cylinder 32 to secure the threaded cylinder 32 to the base plate 23. The proximal portion of a tremolo arm 30 is removably inserted into the threaded cylinder 32. When manipulating the tremolo manipulation mechanism 26 such as when pulling the tremolo arm 30 up and pressing the tremolo arm 30 down, the tremolo arm 30 that is inserted in the threaded cylinder 32 is tilted upward or downward. Tilting the tremolo arm 30 slightly rotates the base plate 23, the bridge saddles 24, and a tremolo block 45 of the tremolo unit 21 about the rotary shafts 29 against the force of the tension applying mechanism 25.

The fine tuning devices 41 will now be described. The fine tuning devices 41 of the first embodiment include the D tuner device 50 provided on the bridge saddle 24 of the sixth string and the fine tuning bolts 42 of the bridge saddles 24 of the first to fifth strings 15. Fine tuning performed by each fine tuning bolt 42 will now be described.

As shown in FIG. 4, a cylindrical boss 23*b* is formed at the rear end of the base plate 23 corresponding to each of the strings 15. Each boss 23*b* has a threaded bore 23*c* to which a screw portion 42*a* of the corresponding fine tuning bolt 42 is tightened. When the screw portion 42*a* of each fine tuning bolt 42 is screwed into the corresponding threaded bore 23*c*, a rod portion 42*c* of the fine tuning bolt 42 is inserted through the corresponding slit 37*e*. At this time, since each lever arm 37 is urged counterclockwise about the corresponding first support shaft 38 by the tension of the corresponding string 15, the rear end 37*f* of the lever arm 37 is engaged with the contact portion 42*d* formed at the lower end of the head portion 42*b* of the fine tuning bolt 42.

Even if the strings 15 are not attached, a coil spring 37*d*, which is located between each lever arm 37 and the corresponding lever arm retainer 35, urges the lever arm 37 upward such that the rear end 37*f* of each lever arm 37 is engaged with the corresponding contact portion 42*d*. Each coil spring 37*d* effectively suppresses noise caused by vibration of the corresponding lever arm 37. Even if the strings 15 are not attached, each coil spring 37*d* causes the rear end 37*f* of the corresponding lever arm 37 abut against the contact portion 42*d* of the corresponding fine tuning bolt 42 and prevents chattering of the rear end 37*f* and the contact portion 42*d*. This facilitates attaching the strings 15 to the tremolo unit 21.

When the head portion 42*b* of each fine tuning bolt 42 is manually rotated, the amount of the screw portion 42*a* of the fine tuning bolt 42 screwed into the corresponding threaded bore 23*c* of the base plate 23 is varied. As a result, the position of each fine tuning bolt 42 with respect to the base plate 23 is shifted upward or downward. Since the rear end 37*f* of each lever arm 37 abuts against the contact portion 42*d* of the corresponding fine tuning bolt 42, the lever arm 37 is shifted upward or downward as the position of the fine tuning bolt 42 with respect to the base plate 23 is shifted. Specifically, since the screw portion 42*a* has a right-hand thread, turning each fine tuning bolt 42 clockwise shifts the fine tuning bolt 42 downward, which in turn lowers the rear end 37*f* of the corresponding lever arm 37 accordingly. As a result, each string receiver 37*b* shown in FIG. 4 is rotated clockwise about the corresponding first support shaft 38 and shifts the end of the corresponding string 15 downward. In this case, since the second contact point Z between the string 15 and the string receiver 37*b* does not change, the tension of the string 15 is increased. Therefore, the string 15 is tuned to a higher pitch. Contrarily, tuning each fine tuning bolt 42 counterclockwise tunes the corresponding string 15 to a lower pitch.

Figure 7:
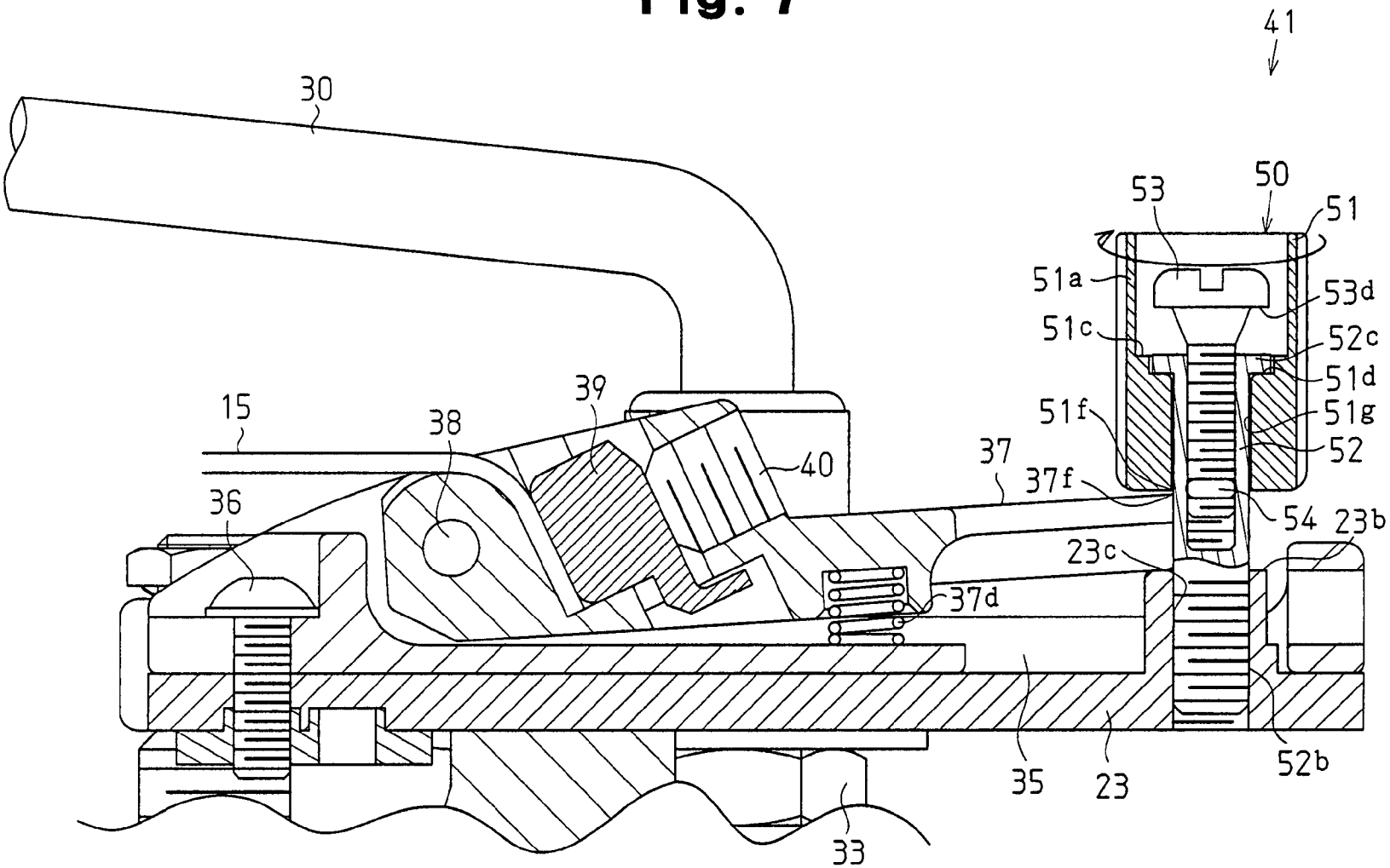
FIG. 7 is a partially enlarged cross-sectional view illustrating the D tuner device of FIG. 3 adjusted to a high tension state (the pitch E)

The D tuner device 50 in the fine tuning devices 41 will now be described. FIG. 7 shows the D tuner device 50 adjusted to a high tension state (the pitch E). As shown in FIG. 7, the D tuner device 50 is attached to the base plate 23 instead of the fine tuning bolt 42 for the sixth string.

Figure 5:
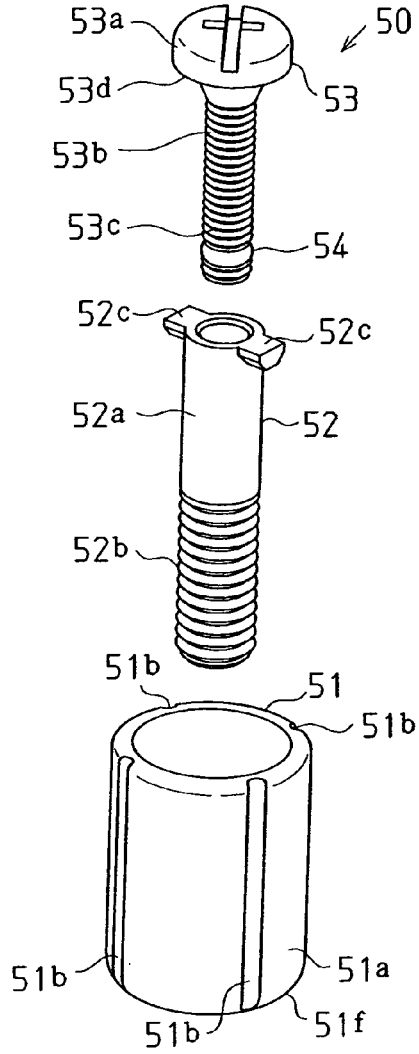
FIG. 5 is an exploded perspective view illustrating the D tuner device.

As shown in FIG. 5, the D tuner device 50 includes a substantially cylindrical tuner knob 51, a base screw 52, which is arranged in the tuner knob 51 and screwed into the corresponding threaded bore 23*c* of the base plate 23, and an adjustment screw 53, which is screwed into the base screw 52 and fine-tunes the string 15 to D (low tension state).

The tuner knob 51 includes a cylinder 51*a*, the upper and lower ends of which are open. In the first embodiment, the height of the cylinder 51*a* is about 1.5 times the diameter of the cylinder 51*a*. Four grooves 51*b*, which extend in the axial direction, are formed on the outer circumference of the cylinder 51*a* at angular intervals of 90 degrees. The grooves 51*b* can be used as marks for determining the rotational position of the tuner knob 51. A lower end 51*f* of the tuner knob 51 abuts against the rear end 37*f* of the corresponding lever arm 37.

Figure 6:
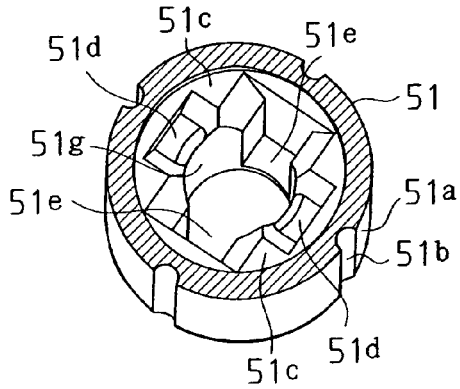
FIG. 6 is a partial perspective view illustrating inside of the tuner knob.

As shown in FIG. 6, a step S1*c*, which includes a flat surface perpendicular to the axial direction of the cylinder 51*a*, is formed at the axially intermediate portion in the cylinder 51*a*. The inner diameter of the cylinder 51*a* at a position lower than the step 51*c*, that is the inner diameter of a lower portion of the tuner knob 51, is smaller than the inner diameter of the cylinder 51*a* at a position above the step 51*c*, that is, the inner diameter of an upper portion of the tuner knob 51, and serves as a insertion hole 51*g* for permitting the base screw 52 to pass through. A pair of engaging recesses 51*d* and a pair of insertion recesses 51*e* are formed at the step 51*c* to have a cruciform shape when viewed from above. The pair of engaging recesses 51*d* is formed by cutting out the step 51*c* at opposing positions with the insertion hole 51*g* in between such that the cross-section of each cut-out portion is semicircle. The pair of insertion recesses 51*e* is formed by cutting out the step 51*c* at opposing positions with the insertion hole 51*g* in between such that the cross-section of each cut-out portion is rectangular and the depth of which is greater than the engaging recesses 51*d*.

As shown in FIG. 5, the base screw 52 includes a cylindrical shaft portion 52*a*, which is inserted in the insertion hole 51*g* below the step 51*c*, and a columnar screw portion 52*b* located below the shaft portion 52*a*. A male thread is formed on the outer circumferential surface of the screw portion 52*b* and is screwed into the corresponding threaded bore 23*c* (see FIG. 7) of the base plate 23. A female thread is formed in the shaft portion 52*a* and the adjustment screw 53 is screwed into the shaft portion 52*a*. A pair of engaging projections 52*c* is formed at the upper end of the shaft portion 52*a*. The cross-section of each engaging projection 52*c* is semicircle and extends in the radial direction. The engaging projections 52*c* can be inserted into the pair of engaging recesses 51*d* or the pair of insertion recesses 51*e*. The shape of the engaging projections 52*c* corresponds to the shape of the engaging recesses 51*d*.

The adjustment screw 53 has a head 53*a* and a threaded portion 53*b*, which is located below the head 53*a*. A recess is formed on the upper surface of the head 53*a* to be engaged with the distal end of a screwdriver. A step portion 53*d*, which abuts against the step 51*c* of the tuner knob 51, is formed on the lower end face of the head 53*a*. The threaded portion 53*b* is screwed into the female thread formed in the shaft portion 52*a* of the base screw 52. Rotation restriction means, which is an O-ring 54 made of rubber, is attached in the vicinity of the lower end of the threaded portion 53*b*. The O-ring 54 slides against the female thread in the shaft portion 52*a* of the base screw 52 and applies friction to prevent loosening of the adjustment screw 53 with respect to the base screw 52.

The operation of the D tuner device 50 will now be described with reference to FIGS. 7 to 9. FIG. 7 shows a state in which the sixth string is tuned to E (high tension state).

When replacing the strings 15 of the guitar 11 shown in FIG. 1, at first, the nut 18 is unlocked to free the strings 15. The strings 15 are then removed and new strings 15 are attached. Subsequently, the tuning pegs 17 are rotated such that each string 15 is adjusted to approximately a predetermined pitch. The strings 15 are then locked with the nut 18 again. As shown in FIG. 7, to fine-tune the D tuner device 50 to the high tension state at the initial adjustment, the engaging projections 52*c* of the base screw 52 are engaged with the engaging recesses 51*d* of the tuner knob 51. At this time, since the tuner knob 51 is urged upward by the corresponding lever arm 37, the lower end 51*f* of the tuner knob 51 constantly contacts the rear end 37*f* of the lever arm 37, and the engagement between the engaging recesses 51*d* of the tuner knob 51 and the engaging projections 52*c* of the base screw 52 is maintained.

Since the engaging projections 52*c* of the base screw 52 are kept engaged with the engaging recesses 51*d* of the tuner knob 51, turning the cylinder 51*a* of the tuner knob 51 integrally turns the base screw 52. Therefore, rotating the cylinder 51*a* changes the amount of the screw portion 52*b* of the base screw 52 screwed into the corresponding threaded bore 23*c* of the base plate 23. More specifically, when the tuner knob 51 is turned clockwise as shown by an arrow in FIG. 7, the screwing amount is increased and the base screw 52 is displaced downward. Accordingly, the lower end 51*f* of the tuner knob 51 presses the lever arm 37 downward. Therefore, the tension of the string 15 is increased thereby raising the pitch. Contrarily, when the tuner knob 51 is rotated counterclockwise, the pitch is lowered. Thus, fine tuning is performed by rotating the tuner knob 51 in either direction. In the initial adjustment, when the tuner knob 51 is rotated, the base screw 52 is rotated integrally with the tuner knob 51. At this time, the adjustment screw 53 rotates integrally with the base screw 52 by the friction between the O-ring 54 and the base screw 52.

Figure 8A:
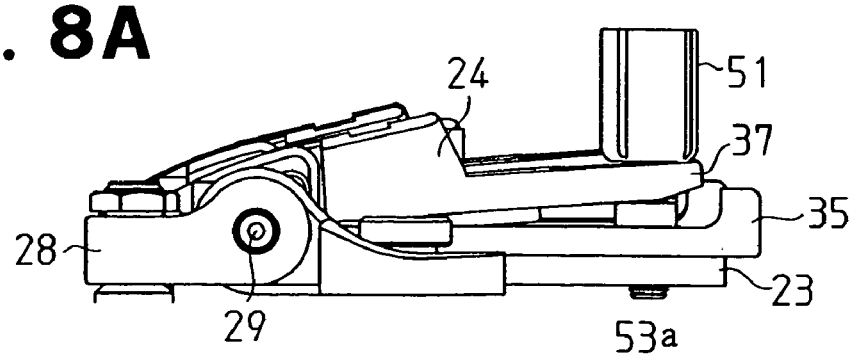
FIGS. 8A to 8D are side views explaining manipulation performed when changing the D tuner device from the pitch E, which is the standard tuning state (high tension state), to the pitch D, which is the alternate tuning state (low tension state)
Figure 8B:
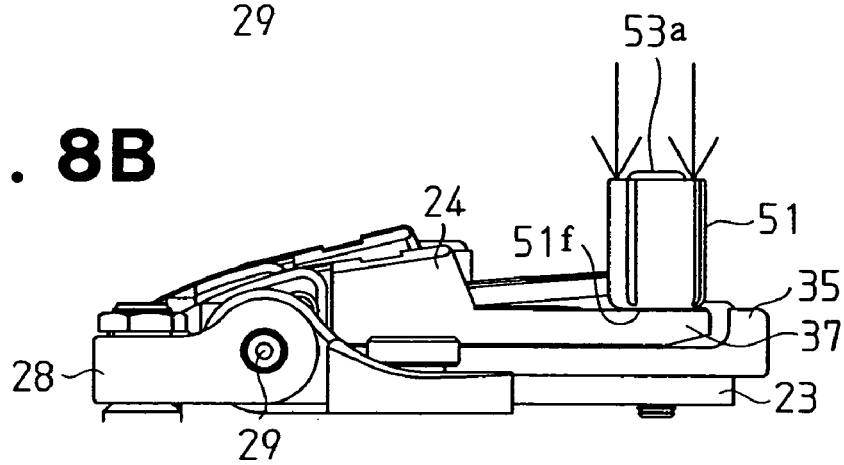
Figure 8C:
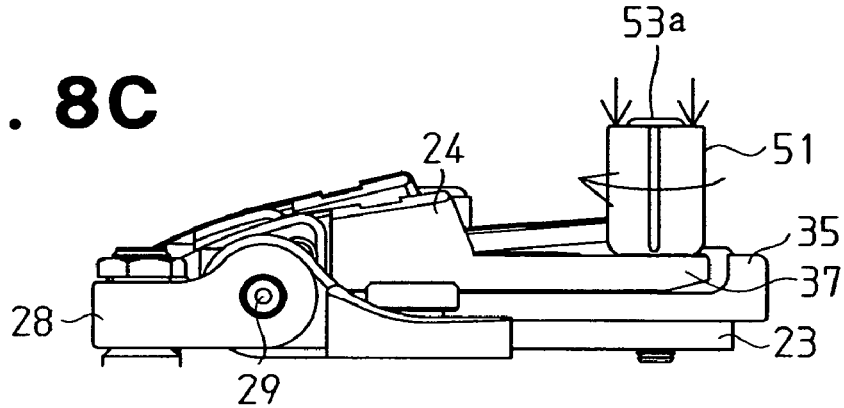

The operation performed when tuning the sixth string to D, which is an alternate tuning state (low tension state), from E, which is the standard state (high tension state), will now be described. FIGS. 7 and 8A show the D tuner device 50 that has adjusted the sixth string to the high tension state. When changing the pitch of the sixth string, the tuner knob 51 of the D tuner device 50 shown in FIG. 8A is pressed downward. Accordingly, the tuner knob 51 is displaced downward and lowers the lever arm 37 via the lower end 51*f* of the tuner knob 51 as shown in FIG. 8B. At this time, since the position of the base screw 52 does not change, the engaging projections 52*c* of the base screw 52 are disengaged from the engaging recesses 51*d* of the tuner knob 51 (see FIG. 9). Subsequently, as shown in FIG. 8C, the tuner knob 51 is rotated clockwise by 90 degrees while pressing the tuner knob 51 downward. The tuner knob 51 is thus rotated relative to the base screw 52 and the insertion recesses 51*e* are shifted to be below the engaging projections 52*c* of the base screw 52.

The four grooves 51*b* located on the outer circumferential surface of the tuner knob 51 at angular intervals of 90 degrees are colored by red and black. More specifically, the pair of grooves 51*b* located opposite to each other with the insertion hole 51*g* for the base screw 52 in between is colored with red and the remaining pair of grooves 51*b* is colored with black. This facilitates performing alternate tuning since the tuner knob 51 is rotated while focusing on the colors of the grooves 51*b*.

Figure 8D:
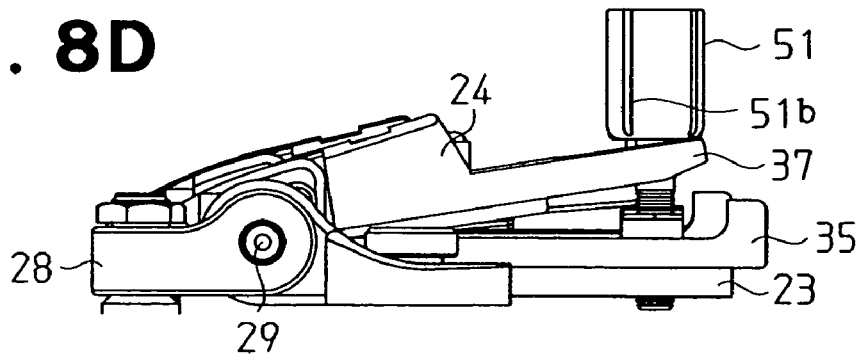

When the pressure on the tuner knob 51 is released from the state shown in FIG. 8C, the tuner knob 51 is pressed upward by the forces of the string 15 and the coil spring 37*d*. Accordingly, the engaging projections 52*c* are inserted into the insertion recesses 51*e*. At this time, the engaging projections 52*c* are laterally locked with the insertion recesses 51*e* (in the rotation direction of the base screw 52), but are not locked in the vertical direction. FIG. 8D shows a state where the downward pressure on the tuner knob 51 is released after the tuner knob 51 is rotated clockwise by 90 degrees.

Figure 9:
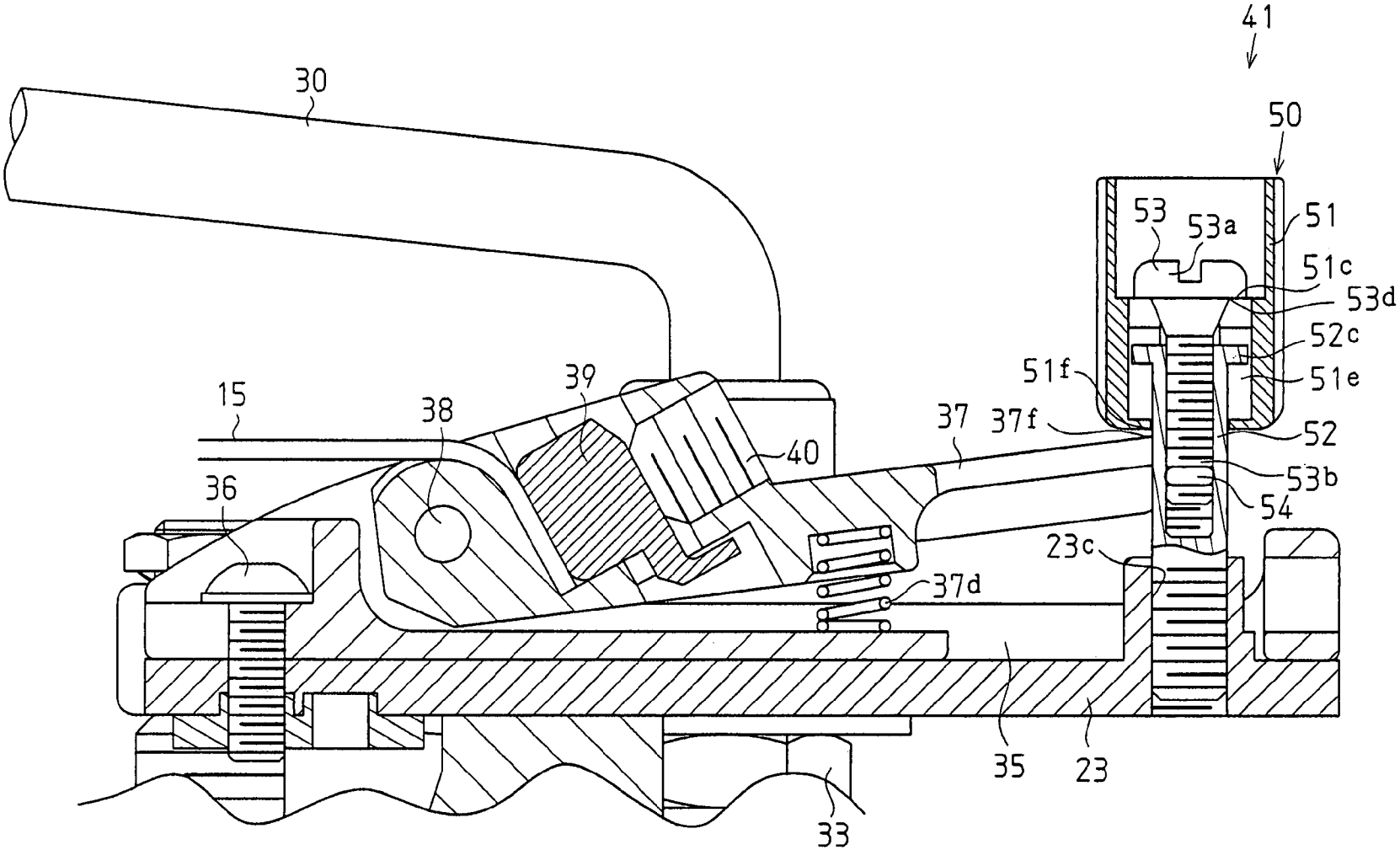
FIG. 9 is a cross-sectional view illustrating the D tuner device that has been changed from the state shown in FIG. 7 to the low tension state (the pitch D)

FIG. 9 is a cross-sectional view of the device in the state shown in FIG. 8D. In the state shown in FIG. 9, the engaging projections 52*c* of the base screw 52 are disengaged from the engaging recesses 51*d* of the tuner knob 51 and are movable in the vertical direction in the insertion recesses 51*e*. At this time, since the tuner knob 51 is urged upward by the corresponding lever arm 37, even if the tuner knob 51 is moved upward, the rear end 37*f* of the lever arm 37 continues to abut against the lower end 51*f* of the tuner knob 51. Furthermore, since the engaging projections 52*c* of the base screw 52 are not engaged with the engaging recesses 51*d* of the tuner knob 51, the tuner knob 51 moves further upward from the position shown in FIG. 7. As a result, before the bottom portions of the insertion recesses 51*e* abut against the engaging projections 52*c*, the step 51*c* of the tuner knob 51 abuts against the step portion 53*d* of the adjustment screw 53 from below. The movement of the tuner knob 51 is therefore restricted at this position. Thus, the height of the tuner knob 51 is determined by the height of the step portion 53*d* of the adjustment screw 53.

Fine-tuning of the sixth string in the alternate tuning state (low tension state) in which the sixth string is tuned down to D from the original pitch E is executed by rotating the adjustment screw 53. A method for fine-tuning under the low tension state will now be described. At first, the head 53*a* of the adjustment screw 53 is rotated with a screwdriver, or the like, while holding the tuner knob 51 by hand to prevent it from rotating. For example, only the adjustment screw 53 is rotated clockwise to fine-tune the sixth string 15 to a higher pitch. This increases the amount of the threaded portion 53*b* of the adjustment screw 53 screwed into the female thread in the shaft portion 52*a* of the base screw 52. At this time, since the base screw 52 is secured to the corresponding threaded bore 23*c* of the base plate 23, the tuner knob 51 can only move downward with respect to the base screw 52. Therefore, if the amount of the threaded portion 53*b* of the adjustment screw 53 screwed into the female thread in the shaft portion 52*a* of the base screw 52 is increased, the adjustment screw 53 moves downward. Accordingly, the head 53*a* of the adjustment screw 53 presses down the tuner knob 51 via the step 51*c*. As a result, the corresponding lever arm 37 is pressed downward and the tension of the string 15 is increased. This raises the pitch of the string 15. Contrarily, when tuning the string 15 to a lower pitch, the head 53*a* of the adjustment screw 53 is rotated counterclockwise while holding the tuner knob 51 by hand to prevent it from rotating.

If the adjustment screw 53 is rotated without holding the tuner knob 51 by hand, the friction of the O-ring 54 causes the base screw 52 to rotate integrally with the adjustment screw 53. This will undesirably shift the base screw 52 in the vertical direction in accordance with the rotation of the adjustment screw 53. In this case, even if fine-tuning in the alternate tuning state (low tension state) is completed, the string 15 is detuned when the string 15 is returned to the standard tuning state (high tension state). Therefore, when performing fine-tuning in the alternate tuning state, it is necessary to hold the tuner knob 51 by hand to prevent the base screw 52 from rotating and rotate only the adjustment screw 53.

Even if the electric guitar 11, the initial adjustment of which has been completed, is played under the low tension state, the friction of the O-ring 54 prevents the adjustment screw 53 from rotating relative to the base screw 52. This prevents undesirable detuning of the electric guitar 11. The strings 15 of the electric guitar 11 might be extended during performance or by a lapse of time resulting in detuning of the electric guitar 11. A method for fine-tuning in such cases (hereinafter, referred to as an adjustment during performance) will be described below. In the adjustment during performance, fine-tuning of each string 15 in the high tension state and, if necessary, fine-tuning of each string 15 in the low tension state are performed.

The adjustment during performance in the high tension state is performed by rotating the tuner knob 51 as in the fine-tuning in the initial adjustment. More specifically, the tuner knob 51 is rotated clockwise while the engaging projections 52*c* and the engaging recesses 51*d* are engaged with each other to increase the tension of the string 15 that is extended during performance.

On the other hand, if fine-tuning in the low tension state is completed at the initial adjustment, the adjustment during performance in the low tension state need not be executed. This is because since the difference between the height of the lower end 51*f* of the tuner knob 51 in the high tension state and that in the low tension state is already adjusted, the pitch difference between the high tension state and the low tension state is maintained at a level that causes no substantial problem even if there is a difference in the tension due to slight extension of the string 15.

However, if fine-tuning in the low tension state is not correct, the adjustment during performance in the low tension state must be performed. The adjustment during performance includes pressing the tuner knob 51 downward and rotating the tuner knob 51 by 90 degrees to change the high tension state shown in FIG. 8A to the low tension state shown in FIG. 8D, and then rotating the tuner knob 51 clockwise. The adjustment during performance differs from the initial adjustment. That is, in the adjustment during performance, the tuner knob 51 and the adjustment screw 53, which rotates integrally with the tuner knob 51, are displaced by the same height. This is because the difference between the height of the lower end 51*f* of the tuner knob 51 in the high tension state and the height of the lower end 51*f* in the low tension state is already adjusted to correspond to one scale in the initial adjustment. Therefore, in the adjustment during performance, by performing fine-tuning in the low tension state while maintaining the difference, the string 15 is tuned at a level that causes no substantial problem. If such fine-tuning is performed, the tuner knob 51 and the adjustment screw 53 rotate integrally with each other. Therefore, the adjustment amount of the fine-tuning in the low tension state is reflected to the adjustment amount of the fine-tuning in the high tension state. That is, when executing the adjustment during performance, the tuner knob 51 is simply rotated by hand without using a tool in both the high tension state and the low tension state. Therefore, the adjustment is easy even during performance.

The tension applying mechanism 25 of the tremolo unit 21 will now be described. As shown in FIG. 3, the tremolo unit 21 includes the bridge saddles 24, which retain the strings 15 on their upper surfaces, the base plate 23, which has the tremolo block 45 attached to the lower surface, the tremolo manipulation mechanism 26, which includes the tremolo arm 30, and the tension applying mechanism 25. The tremolo arm 30 is detachably mounted on the base plate 23 to tilt the base plate 23. The tension applying mechanism 25 is a mechanism for restoring the base plate 23 to a balanced position after tilting the base plate 23. In the first embodiment, the tension applying mechanism 25 is located in a recess formed on the backside of the body 12.

In the first embodiment, the six bridge saddles 24 are independently arranged on the base plate 23. Each bridge saddle 24 corresponds to one of the strings 15, and the harmonics of each string 15 can be tuned. FIG. 3 shows the tremolo unit 21 in a non-operational state. As shown in FIG. 2, the base plate 23 is tiltably supported by the pair of brackets 28 via the hinge mechanisms 22 formed on both sides of the front portion (toward the neck 13) of the base plate 23.

Figure 10:
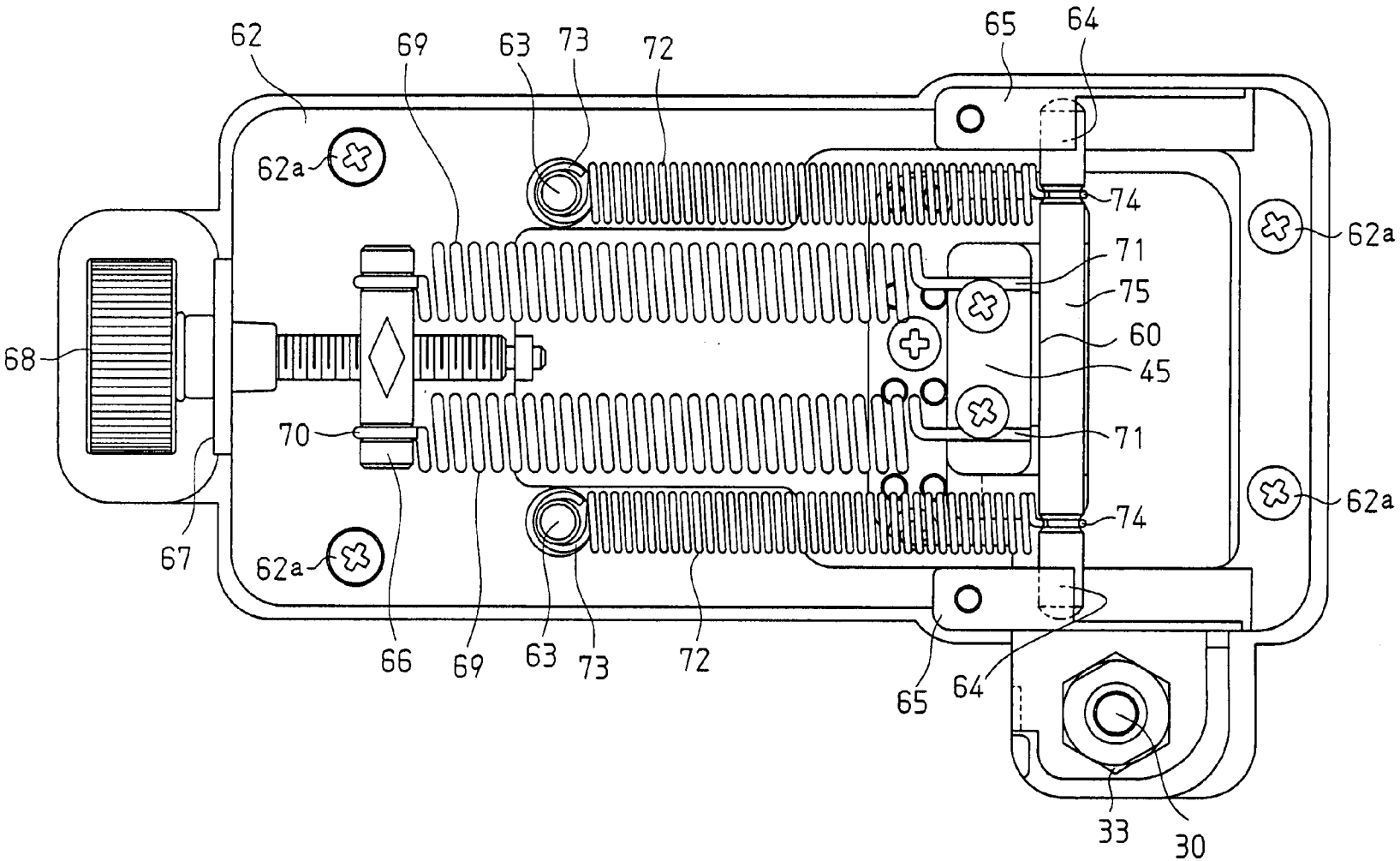
FIG. 10 is a bottom view illustrating a tension applying mechanism located at the lower surface of the body.

As shown in FIGS. 3 and 10, according to the tension applying mechanism 25 of the first embodiment, a hook portion 60 of the tremolo block 45, which is attached to the lower surface of the base plate 23, is urged forward of the body 12 by two springs 69. The hook portion 60 is formed on the tremolo block 45 and abuts against a support rod 75 when the tremolo block 45 is moved rearward. The support rod 75 is arranged to extend in a direction perpendicular to the neck 13 at the rear of the tremolo block 45.

A base 62 is secured inside the recess formed in the backside of the body 12 with screws 62*a*. A support piece 67, which is bent downward, is located at the front end of the base 62. Engaging portions 64 are formed on both sides of the base 62 at the rear portion to be engaged with both ends of the support rod 75. Each engaging portion 64 has an opening facing rearward. Upright pieces 65 project downward at both sides of the base 62. Each engaging portion 64 of the first embodiment includes a V-shaped notch at the rear portion of the corresponding upright piece 65. An adjustment member 66 is arranged at the front portion of the base 62 extending in parallel with the support rod 75. The adjustment member 66 of the first embodiment is screwed into the distal end of an adjustment screw 68, which is rotatably inserted in the support piece 67. Rotating the adjustment screw 68 moves the adjustment member 66 forward and rearward.

The pair of first springs 69 have front ends 70, which are fixed to the adjustment member 66. Rear ends 71 of the first springs 69 are secured to the lower portion of the tremolo block 45 to constantly urge the tremolo block 45 forward. Front ends 73 of a pair of second springs 72 are secured to a pair of engaging pins 63, which project from the base 62. In the first embodiment, the second springs 72 are located beside the first springs 69 such that the first springs 69 are located in between.

The support rod 75 is located rearward of the tremolo block 45. A rear end 74 of each second spring 72 is secured to the support rod 75 and constantly urges the support rod 75 forward. The support rod 75 is engaged with the engaging portions 64 when the tremolo block 45 is not operated and when the tremolo block 45 is moved forward in accordance with manipulation of the tremolo arm 30. On the other hand, when the tremolo block 45 is moved rearward in accordance with manipulation of the tremolo arm 30, the support rod 75 is pressed by the hook portion 60 of the tremolo block 45 and moved rearward of the engaging portions 64. In this case, the support rod 75 slides with respect to the lower inclined surface of the notch of each engaging portion 64 and moves rearward. In this embodiment, the engaging portions 64, the second springs 72, and the support rod 75 form urging force maintaining means.

As described above, the force of the first springs 69, which urges the tremolo block 45, can be controlled by adjusting the position of the adjustment member 66 using the adjustment screw 68. This facilitates using several kinds of string gauges. The inclination of the base plate 23 with respect to the stud bolts 31 can also be adjusted.

When the base plate 23 is at the balanced position, the first springs 69 connect the adjustment member 66 and the tremolo block 45 in a state extended from a natural length and urge the tremolo block 45 forward. On the other hand, when the base plate 23 is at the balanced position, the second springs 72 connect the engaging pins 63 of the base 62 and the support rod 75 in a state extended from a natural length and urge the support rod 75 forward. At this time, both ends of the support rod 75 are engaged with the pair of engaging portions 64.

In the tremolo unit 21 described above, when the strings 15 are not tensioned, the tremolo block 45 is arranged at the up front position within the movable range being pulled by the first springs 69. When tension is applied to each string 15 during tuning, the base plate 23 tilts counterclockwise about the hinge mechanisms 22 and the tremolo block 45 moves rearward. At this time, if the force of the first springs 69 acting on the tremolo block 45 is weak, the hook portion 60 of the tremolo block 45 abuts against the support rod 75 and presses the support rod 75 rearward away from the engaging portions 64. Contrarily, when the force of the first springs 69 acting on the tremolo block 45 is strong, the hook portion 60 stops before contacting the support rod 75. In either case, the tremolo unit 21 is in a very unstable state.

Therefore, it is desirable that the forces of the first springs 69 and the second springs 72 be adjusted such that the hook portion 60 of the tremolo block 45 abuts against the support rod 75 and the support rod 75 abuts against the engaging portions 64. However, the force of the first and second springs 69, 72 is not necessarily adjusted as described above depending on the preference of the player. The second springs 72 and the support rod 75 can easily be removed from the base 62. Members such as the hook portion 60 of the tremolo block 45 and the engaging portions 64 may be formed of shock absorbing members such as rubber. In this case, shock generated when the support rod 75 abuts against the hook portion 60 or the engaging portions 64 is absorbed and generation of noise is prevented.

An operation of the tension applying mechanism 25 will now be described. When the tremolo arm 30 shown in FIG. 2 is pressed downward, the rear portion of the base plate 23 moves to tilt upward about the hinge mechanisms 22. This reduces the tension of all the strings 15 and the strings 15 are tuned down. At this time, the tremolo block 45 shown in FIG. 3 is rotated rearward in the space formed in the body 12. Accordingly, the pair of first springs 69, which couple the adjustment member 66 and the tremolo block 45, are extended. At the same time, the tremolo block 45 extends the pair of second springs 72 while causing the hook portion 60 abut against the support rod 75 to separate the support rod 75 from the engaging portions 64 rearward.

When the tremolo arm 30 that has been pressed downward is released, the tremolo block 45 rotates forward in the space formed in the body 12 about the hinge mechanisms 22 by force of the first springs 69 and the second springs 72. As a result, the tremolo block 45 is restored to the balanced position before the tremolo arm 30 was pressed down. The support rod 75 also moves forward and is engaged with the engaging portions 64.

Contrarily, when the tremolo arm 30 is pulled upward, the rear portion of the base plate 23 moves to tilt downward about the hinge mechanisms 22. This increases the tension of all the strings 15 and the strings 15 are tuned up. At this time, the tremolo block 45 is rotated forward in the space formed in the body 12. Accordingly, the pair of first springs 69, which couple the adjustment member 66 and the tremolo block 45, are contracted. At this time, the support rod 75 is kept engaged with the engaging portions 64. When the tremolo arm 30 that has been pulled upward is released, the tremolo block 45 rotates rearward in the space formed in the body 12 about the hinge mechanisms 22 by the tension of the strings 15 and is restored to the balanced position before the tremolo arm 30 was pulled upward.

An operation when performing alternate tuning of the electric guitar 11 equipped with the tremolo unit 21 using the D tuner device 50 of the first embodiment will now be described. As described above, the sixth string is fine-tuned to E, which is the standard tuning state, using the D tuner device 50. Meanwhile, the base plate 23 is adjusted to the balanced position with the adjustment screw 68. In the case with this electric guitar 11, the balanced position of the base plate 23 is maintained as it is. Furthermore, the tremolo arm 30 can be pulled upward or pressed downward while playing the electric guitar 11.

Subsequently, when the sixth string is tuned to D, which is the alternate tuning state, using the D tuner device 50, the total tension of the six strings 15 is reduced as compared to a case where the sixth string is fine-tuned to E. In this case also, if the total tension of all the strings 15 is greater than the total tension of the first springs 69, and is less than the total tension of the first springs 69 and the second springs 72, the base plate 23 does not move from the balanced position and keeps the balanced state obtained at the initial adjustment. That is, since the support rod 75 is maintained abutting against the engaging portions 64 and the hook portion 60 of the tremolo block 45 is maintained abutting against the support rod 75, even if the D tuner device 50 is changed from the high tension state to the low tension state, other strings 15 are not detuned.

The first embodiment has the following advantages.

In the first embodiment, since the D tuner device 50 is provided, the sixth string is easily changed from the standard tuning state to the alternate tuning state by fingertips of a single hand while playing the guitar 11. That is, in this embodiment, the tuner knob 51 is set to have a first height relative to the base plate 23 in the high tension state, and is set to have a second height relative to the base plate 23 in the low tension state, which second height is higher than the first height. The height of the tuner knob 51 is easily changed by rotating the tuner knob 51 with fingertips of a single hand. Contrarily, the sixth string is easily changed from the alternate tuning state to the standard tuning state.

The D tuner device 50 does not include members that project rearward of the bridge by a large amount like the tension changing device of a stringed instrument that is equipped with a tremolo unit such as that disclosed in the U.S. Pat. No. 5,359,144. Furthermore, a conventional bridge for guitars can be replaced with the bridge of the first embodiment. Therefore, the bridge of the first embodiment has a wide use.

The D tuner device 50 can independently fine-tune the pitch in the standard tuning state and the pitch in the alternate tuning state at the initial adjustment. As a result, since the pitches are maintained even if the tuning state is changed, a correct pitch is easily reproduced.

Furthermore, when the initial adjustment is completed, the O-ring 54 maintains the pitch difference between the standard tuning state and the alternate tuning state, that is, the relative position between the adjustment screw 53 and the base screw 52. Therefore, in the adjustment during performance, fine-tuning can be performed by a simple manipulation of rotating the tuner knob 51 in both the standard tuning state and the alternate tuning state. For example, if the string 15 is extended during performance, fine-tuning is simultaneously completed by simply rotating the tuner knob 51 in either the standard tuning state or the alternate tuning state. In this case, the O-ring 54 located at the threaded portion 53*b* of the adjustment screw 53 prevents relative rotation between the adjustment screw 53 and the base screw 52. Thus, the string 15 is not detuned even during performance. An urging member such as a spring or an adhesive may be provided instead of the O-ring 54 to prevent undesirable rotation of the base screw 52 relative to the adjustment screw 53.

The tuner knob 51 includes the grooves 51*b*, which are colored with two colors. Therefore, the tuning state can be grasped at a glance. Particularly, it is convenient that the tuning state can be reliably changed by rotating the tuner knob 51 by 90 degrees based on the position of the grooves 51*b*. The tuner knob 51 may also be rotated by an angle other than 90 degrees to change the tuning state. The number of the grooves 51*b* (marks) is not limited to four, but may be any number greater than one. In such a case, the grooves 51*b* (marks) are distinguished by using at least two colors.

Since the thread having the same pitch is formed on the screw portion 42*a* of the fine tuning bolt 42 and the screw portion 52*b* of the base screw 52, the fine tuning bolt 42 and the D tuner device 50 can be exchanged. Therefore, the alternate tuning can be performed on any of the strings 15 other than the sixth string. In this case, the low tension state may be the standard tuning state and the high tension state may be the alternate tuning state. Also, the difference between the pitches in the standard tuning state and the alternate tuning state need not be a whole step, but may be a half step or a one and half steps or more.

When changing the high tension state and the low tension state, if the change in the tension of the strings 15 is within a predetermined range, the tension applying mechanism 25 need not be adjusted every time the alternate tuning is performed since the tension applying mechanism 25 prevents the strings 15 from being detuned. The predetermined range refers to a range in which the total tension of the six strings 15 is greater than the total tension of the pair of first springs 69 and is smaller than the total tension of the first springs 69 and the second springs 72. As long as the change in the tension of the strings 15 is within the predetermined range, even if the tuning state of several strings 15 are simultaneously changed, the strings 15 are not detuned. Therefore, modulation of the tension of one string 15 as in the first embodiment does not require an adjustment.

A second embodiment of the present invention will now be described. An electric guitar 211 of the second embodiment differs from that of the first embodiment in that the tremolo unit 21 is not provided. Like or the same reference numerals are given to those components that are like or the same as the corresponding components of the first embodiment. Mainly, the differences from the first embodiment will be discussed below.

Figure 11:
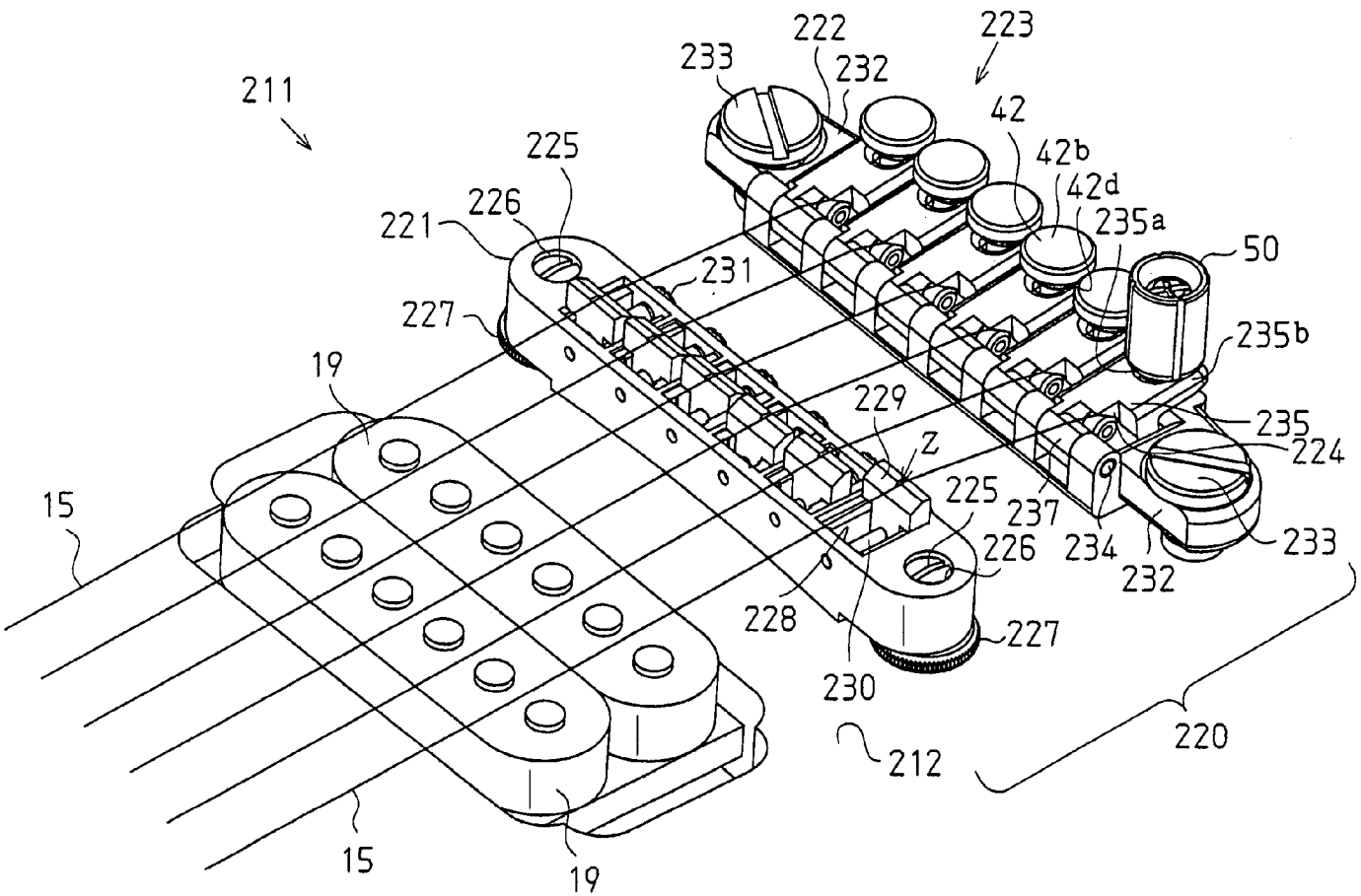
FIG. 11 is a partial perspective view illustrating the vicinity of a bridge set of an electric guitar according to a second embodiment.

As shown in FIG. 11, a bridge set 220 is constituted by a bridge piece 221 and a tail piece 222. The bridge piece 221 includes saddles 229, each of which contacts one of the strings 15 at the second contact point Z. The tail piece 222 includes fine tuning devices 223. The bridge piece 221 and the tail piece 222 may also be formed integrally with each other. The pickups 19 are located in front (toward the head) of the bridge piece 221.

The bridge piece 221 is fixed to a body 212 with a pair of first anchor bolts 225. An annular height adjustment plate 227 is attached to each first anchor bolt 225 between the bridge piece 221 and the body 212. Rotating the height adjustment plates 227 displaces the bridge piece 221 in the height direction. The bridge piece 221 extends in a direction (width direction) perpendicular to the strings 15. A first insertion hole 226 is formed on each of the ends of the bridge piece 221 to permit the corresponding anchor bolt 225 through. The bridge piece 221 is supported by the body 212 by inserting each anchor bolt 225 into one of the first insertion holes 226, and the height of the bridge piece 221 with respect to the upper surface of the body can be adjusted by the height adjustment plates 227. The bridge piece 221 has opening portions 228, which are open upward. Each opening portion 228 corresponds to one of the strings 15. Each opening portion 228 has the T-shaped saddle 229. The upper portion of each saddle 229 is shaped as a roof having a ridge, and contacts the corresponding string 15 at the ridge forming the second contact point Z.

A guide shaft 230, which extends parallel to the corresponding string 15, is formed at the lower portion of each opening portion 228. Each guide shaft 230 guides the corresponding saddle 229 to move only forward and rearward. Harmonic adjustment screws 231 are inserted from the rear surface of the bridge piece 221. Each harmonic adjustment screw 231 corresponds to one of the strings 15. Since the front end of each harmonic adjustment screw 231 is rotatably coupled to the rear portion of the corresponding saddle 229, the saddle 229 can be moved forward and rearward by rotating the harmonic adjustment screw 231. That is, the harmonics of each string 15 can be tuned by rotating the corresponding harmonic adjustment screw 231.

The tail piece 222 includes a rectangular base plate 232. The longitudinal direction of the base plate 232 extends in a direction (width direction) perpendicular to the strings 15. The base plate 232 is secured to the body 212 by inserting second anchor bolts 233 at both ends of the base plate 232. A second support shaft 234, which extends in the width direction, is located at the front portion of the base plate 232 to rotatably couple lever arms 235. That is, the base plate 232 retains lever arms 235 by the second support shaft 234. A slit 235*a* is formed at a plate-like rear end of each lever arm 235. Each fine tuning bolt 42 according to the first embodiment is inserted into the slit 235*a* of one of the lever arms 235, which are connected to the first to fifth strings, respectively. The rear portion of each lever arm 235 can be rotated upward with respect to the base plate 232. The rear end 235*b* of each lever arm 235 abuts against the contact portion 42*d* located at the lower end of the head portion 42*b* of the corresponding fine tuning bolt 42.

A cylindrical string receiver 237 is formed at the front end of each lever arm 235 with its center at the second support shaft 234. Each lever arm 235 includes a string retainer 224 rearward of the string receiver 237. Each string retainer 224 has a recess to be engaged with the rear end of the corresponding string 15. The rear end of each string 15 is engaged with the recess of the corresponding string retainer 224 and abuts against the corresponding string receiver 237. Each string 15 contacts the upper end of the corresponding saddle 229 in front of the corresponding string receiver 237 forming the second contact point Z. The tension of each string 15 urges the corresponding string retainer 224 to be rotated upward about the second support shaft 234. Thus, each lever arm 235 urges the contact portion 42*d* of the corresponding fine tuning bolt 42 upward via the rear end 235*b*. Therefore, rotating each fine tuning bolt 42 displaces the height of the corresponding rear end 235*b*. As a result, the rotation amount of the corresponding lever arm 235 is changed and the pitch is changed.

The D tuner device 50 abuts against the lever arm 235 corresponding to the sixth string instead of the fine tuning bolt 42. Since the electric guitar 211 of the second embodiment includes the D tuner device 50 that is the same as that of the first embodiment, specific operations and advantages derived from the D tuner device 50 are provided. In addition, the bridge piece 221, which includes the second contact points Z, and the tail piece 222, which includes the fine tuning devices 223, are separated from each other in the second embodiment. Therefore, the tail piece 222 of the second embodiment can be mounted on the conventional electric guitar that has a separated tail piece. In this case, the second embodiment may be applied to an acoustic guitar that is not equipped with a tremolo unit. According to the electric guitar 211 of the second embodiment, the harmonics of each string 15 can be tuned by rotating the corresponding harmonic adjustment screw 231 with a screwdriver to move the saddle 229 forward and rearward. Therefore, the corresponding fine tuning device 223 need not be moved. As a result, the electric guitar 211 is not easily detuned.

It should be apparent to those skilled in the art that the present invention may be embodied in many other specific forms without departing from the spirit or scope of the invention. Particularly, it should be understood that the invention may be embodied in the following forms.

In the first embodiment, the second springs 72 and the support rod 75 may be omitted. In this case, the adjustment screw 68 needs to be manually adjusted each time the tuning state is changed. However, the tremolo unit 21 can be manipulated more naturally. This also simplifies the structure of the tension applying mechanism. In this case, the adjustment member 66 and the adjustment screw 68 form urging force adjusting means.

In the first embodiment, the pith of the strings 15 can be adjusted at the bridge section even after the pressing member is locked. Therefore, although the locking nut is preferably applied, a normal nut may also be applied.

In the second embodiment, the tremolo unit may be mounted on the tail piece 222.

Figure 12:
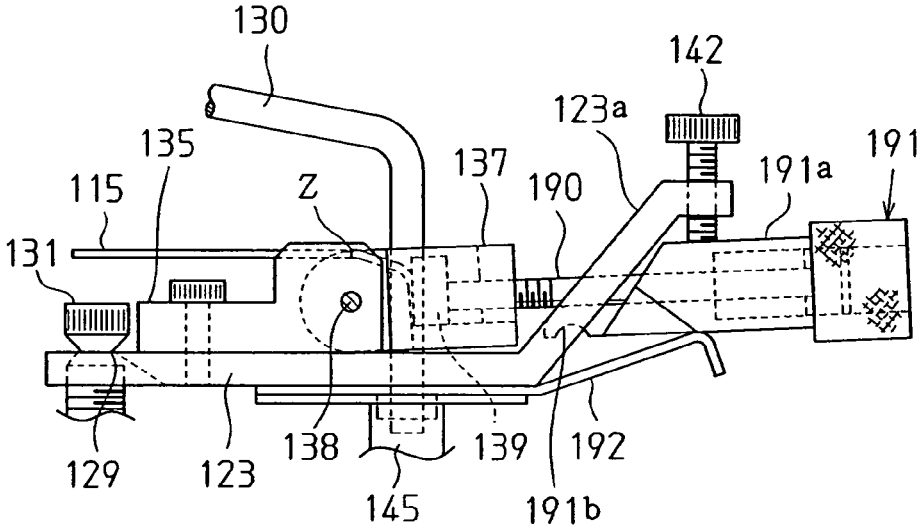
Fig. 12 (Prior Art)
FIG. 12 is a side view illustrating a tension changing device of a conventional stringed instrument adjusted to a standard tuning state.
Figure 13:
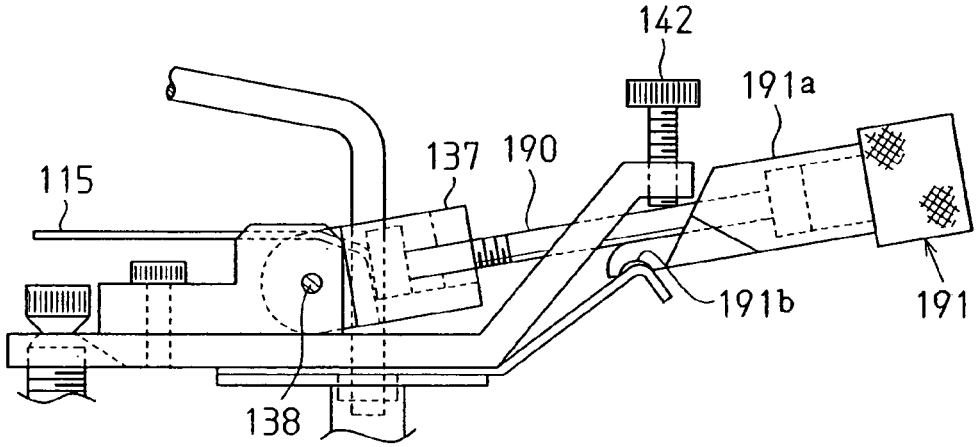
Fig. 13 (Prior Art)
FIG. 13 is a side view illustrating the tension changing device of the conventional stringed instrument in which the pitch of the sixth string is tuned down a whole step from the state shown in FIG. 12.

In the second embodiment, the fine tuning devices 41, 223 may be applied to the conventional structure shown in FIG. 12.

In the second embodiment, the D tuner device 50 need not be provided on the sixth string, but may be provided on several strings 15.

The second embodiment is described using the six-stringed electric guitar as an example. However, the present invention may be applied to electric guitars such as a seven-stringed guitar or a four-stringed base, or stringed instruments such as an acoustic guitar or a harp. The number of the strings 15 is also not restricted.

In the second embodiment, the alternate tuning of only the sixth string is explained as an example. However, the tensions of several strings 15 may be designed to change in conjunction with each other and the tuning state of the strings 15 may be simultaneously changed.

In the second embodiment, the D tuner device 50 may have any structure as long as the position of the lower end 51*f* can be changed with respect to the base screw 52 and the position of the lower end 51*f* can be fixed at that position. For example, the tuner knob 51 may be rotated using downward force like the knocking-type ballpoint pen. Alternatively, an external cylinder may be fitted to the outer circumference of the tuner knob 51 and pin engaging holes may be provided between the tuner knob 51 and the external cylinder to be engaged with pins. In this case, the height of the external cylinder is changed with respect to the tuner knob 51 by changing the position of the pins with respect to the pin engaging holes. Also, L-shaped notches may be formed in the external cylinder and projections may be formed on the outer circumference of the tuner knob 51. In this case, the notches and the projections are secured to each other.

Therefore, the present examples and embodiments are to be considered as illustrative and not restrictive and the invention is not to be limited to the details given herein, but may be modified within the scope and equivalence of the appended claims.

What is claimed is:

1. A bridge for a stringed instrument, the bridge being located on an upper surface of a body of a stringed instrument equipped with a plurality of strings, the bridge comprising:

a plurality of lever arm retainers located on the upper surface of the body, each lever arm retainer corresponding to one of the strings, and each lever arm retainer including a support shaft extending in a direction perpendicular to the corresponding string;

a plurality of lever arms, each arm of the plurality of lever arms being supported by one of the support shafts, each lever arm retaining an end of the one of the strings and being rotatable about the corresponding support shaft;

a plurality of fine tuning bolts, each fine tuning bolt of the plurality of fine tuning bolts being located in a rear portion of one of the lever arm retainers, each fine tuning bolt including a contact portion that abuts against the corresponding lever arm above the body, wherein each contact portion is operative to be continuously adjustable in a height direction of the body; and a tuner device located on each fine tuning bolt that corresponds to at least one of the strings, the tuner device being operable to produce two distinct pitches for the at least one of the strings by selectively and discretely changing a height of the contact portion between a first height corresponding to a first one of the two distinct pitches and a second height corresponding to a second one of the two distinct pitches, the first height being lower than the second height, wherein each lever arm has a rear end that abuts against the corresponding contact portion, wherein, in a state in which the contact portion is set to either the first height or the second height, the tuner device is operative to continuously adjust the position of the rear end of the each lever arm to abut against the corresponding contact portion, wherein each fine tuning bolt comprises:

a base screw positioned in the rear portion of one of the lever arm retainers, the base screw including a cylindrical shaft portion at the upper portion of the base screw, the cylindrical shaft portion including a female thread formed inside the cylindrical shaft portion, and at least one engaging projection positioned on the outer surface of the base screw;

an adjustment screw screwed into the inside of the shaft portion, the adjustment screw including a head, a diameter of the head being greater than a diameter of the shaft portion; and a cylindrical tuner knob covering the outer circumference of the shaft portion, the lower end of the tuner knob abutting against the upper surface of the corresponding lever arm, the tuner knob having an upper portion and a lower portion, the lower portion having an inner diameter that is smaller than an inner diameter of the upper portion;

a step formed between the upper portion and the lower portion, the step having an upper surface abutting against a lower end of the head of the adjustment screw, and at least one engaging recess and at least one insertion recess being formed in the step, the engaging projection being engaged with the engaging recess, and the engaging projection being inserted in the insertion recess, and wherein, when the engaging projection is engaged with the engaging recess, relative rotation of the tuner knob with respect to the base screw and movement of the tuner knob in the height direction with respect to the base screw are restricted, so that the lower end of the tuner knob is set to the first height, and when the engaging projection is inserted in the insertion recess, relative rotation of the tuner knob with respect to the base screw is restricted, and the upper surface of the step abuts against the lower end of the head, so that the lower end of the tuner knob is set to the second height.

2. The bridge for a stringed instrument according to claim 1, wherein the engaging recess and the insertion recess are located at different positions of the step, the widths of the engaging recess and the insertion recess corresponding to the width of the engaging projection, and the bottom of the insertion recess located lower than the bottom of the engaging recess.

3. The bridge for a stringed instrument according to claim 1, wherein the tuner knob includes a pair of engaging recesses facing each other, with an insertion hole for the base screw in between, and a pair of insertion recesses, which face each other with the insertion hole in between, and the engaging recesses and the insertion recesses are formed to have a cruciform shape.

4. The bridge for a stringed instrument according to claim 3, wherein a mark is formed on the outer surface of the tuner knob to grasp the rotational position of the tuner knob, the mark being formed of four grooves extending in the axial direction of the tuner knob, and the grooves are formed on the outer surface of the tuner knob at equal intervals.

5. The bridge for a stringed instrument according to claim 4, wherein the grooves are colored with two kinds of colors, and each groove is colored with the same color as the opposing groove with the insertion hole for the base screw in between.

6. The bridge for a stringed instrument according to claim 1, wherein a plurality of marks are formed on the outer surface of the tuner knob to grasp the rotational position of the tuner knob.

7. The bridge for a stringed instrument according to claim 6, wherein the marks are distinguished by using at least two colors.

8. The bridge for a stringed instrument according to claim 1, further comprising a rotation restricting member between the adjustment screw and the shaft portion, the rotation restricting member being operable for increasing friction and preventing relative rotation between the adjustment screw and the shaft portion.

9. The bridge for a stringed instrument according to claim 8, wherein the rotation restricting member is an O-ring.

10. The bridge for a stringed instrument according to claim 1, wherein each lever arm includes a slit extending rearward, one of the fine tuning bolts is inserted through the slit from above and is coupled to the corresponding lever arm retainer, and the contact portion abuts against the rim of the slit.

11. The bridge for a stringed instrument according to claim 1, further comprising a tremolo unit.

12. The bridge for a stringed instrument according to claim 11, wherein the tremolo unit includes a tension applying mechanism operative to maintain the tension of the strings by applying a force that acts against the tension of the strings, the tension applying mechanism including an urging force adjusting unit, and wherein, in a state in which the contact portion is set to either the first height or the second height, the urging force adjusting unit adjusts the urging force in accordance with the tension of the strings.

13. The bridge for a stringed instrument according to claim 11, wherein the tremolo unit includes a tension applying mechanism for maintaining the tension of the strings by applying a force that acts against the tension of the strings, the tension applying mechanism including an urging force maintaining unit, and wherein, when the tension of a specific one of the strings is changed when the height of the contact portion is changed between the first height and the second height, the urging force maintaining unit adjusts the urging force such that the tension of each of the other strings remains unchanged.

14. The bridge for a stringed instrument according to claim 13, the tension applying mechanism comprising:

a base plate supported by the body, the base plate being tiltable on the body;

a tremolo block, which projects at the lower surface of the base plate, the tremolo block being tiltable inside the body;

a base of the tremolo block;

a first spring provided between the base and the tremolo block, the first spring being operable to urge the tremolo block forward of the body, so that an adjustable urging force is applied to the tremolo block by the first spring;

a support rod located rearward of the tremolo block and parallel to the tremolo block;

a pair of engaging portions located on both sides of the base, each engaging portion being engaged with the support rod; and a second spring, which couples the support rod to the base, the second spring adapted to urge the support rod forward of the body.

15. The bridge for a stringed instrument according to claim 14, wherein the tension applying mechanism is balanced with the tension of the strings in a state in which the support rod is engaged with the engaging portions and the tremolo block abuts against the support rod.

16. The bridge for a stringed instrument according to claim 1, wherein each lever arm has a contact point at which the lever arm contacts the associated string above the corresponding support shaft, each lever arm being adapted to retain an end of the associated string rearward of the contact point.

17. A stringed instrument including a plurality of strings, the stringed instrument being equipped with a bridge located on an upper surface of a body, the bridge comprising:

a plurality of lever arm retainers located on the upper surface of the body, each lever arm retainer corresponding to one of the strings, and each lever arm retainer including a support shaft extending in a direction perpendicular to the corresponding string;

a plurality of lever arms each supported by one of the support shafts, each lever arm retaining an end of the one of the strings and being rotatable about the corresponding support shaft;

a plurality of fine tuning bolts, each fine tuning bolt of the plurality of fine tuning bolts positioned in a rear portion of one of the lever arm retainers, each fine tuning bolt including a contact portion that abuts against the corresponding lever arm above the body, wherein each contact portion is operable to be continuously adjustable in the height direction of the body; and a tuner device located on each fine tuning bolt that corresponds to at least one of the strings, the tuner device being operable to produce two distinct pitches for said at least one of the strings by selectively and discretely changing a height of the contact portion between a first height corresponding to a first one of the two distinct pitches and a second height corresponding to a second one of the two distinct pitches, the first height being lower than the second height, wherein each lever arm has a rear end that abuts against the corresponding contact portion, and wherein, in a state in which the contact portion is set to either the first height or the second height, the tuner device is operable to continuously adjust the position of the rear end of the each lever arm to abut against the corresponding contact portion, wherein each fine tuning bolt comprises:

a base screw positioned in the rear portion of one of the lever arm retainers, the base screw including a cylindrical shaft portion at the upper portion of the base screw, the shaft portion including a female thread formed inside the shaft portion, and at least one engaging projection formed on the outer surface of the base screw;

an adjustment screw screwed into the inside of the shaft portion, the adjustment screw including a head, a diameter of the head being greater than the diameter of the shaft portion; and a cylindrical tuner knob covering the outer circumference of the shaft portion, the lower end of the tuner knob abutting against the upper surface of the corresponding lever arm, the tuner knob having an upper portion and a lower portion, the lower portion having an inner diameter that is smaller than an inner diameter of the upper portion;

a step formed between the upper portion and the lower portion, the step having an upper surface abutting against a lower end of the head of the adjustment screw, and at least one engaging recess and at least one insertion recess being formed in the step, the engaging projection being engaged with the engaging recess, and the engaging projection being inserted in the insertion recess, wherein, when the engaging projection is engaged with the engaging recess, relative rotation of the tuner knob with respect to the base screw and movement of the tuner knob in the height direction with respect to the base screw are restricted, so that the lower end of the tuner knob is set to the first height, and when the engaging projection is inserted in the insertion recess, relative rotation of the tuner knob with respect to the base screw is restricted, and the upper surface of the step abuts against the lower end of the head, so that the lower end of the tuner knob is set to the second height.

* * * * *

UNITED STATES PATENT AND TRADEMARK OFFICE

CERTIFICATE OF CORRECTION

PATENT NO. : 7,235,730 B2
APPLICATION NO. : 11/040309
DATED : June 26, 2007
INVENTOR(S) : Shinjiro Hirayama It is certified that error appears in the above-identified patent and that said Letters Patent is hereby corrected as shown below:

Title Page should read;
(73) Assignee: Hoshino Gakki Co., Ltd. (JP)

Signed and Sealed this

Fourth Day of September, 2007

JON W. DUDAS
*Director of the United States Patent and Trademark Office*